US007677338B2

(12) United States Patent
Overstreet et al.

(10) Patent No.: US 7,677,338 B2
(45) Date of Patent: Mar. 16, 2010

(54) SYSTEM, METHOD, AND APPARATUS FOR PASSIVE AND ACTIVE UPDRILL FEATURES ON ROLLER CONE DRILL BITS

(76) Inventors: James L. Overstreet, 19326 Hoffman Estates Blvd., Tomball, TX (US) 77377; Robert J. Buske, 6 N. Evangeline Oaks Cir., The Woodlands, TX (US) 77384-5008; Jeremy K. Morgan, 7747 Cattle Trail Rd., Midway, TX (US) 75852

( * ) Notice: Subject to any disclaimer, the term of this patent is extended or adjusted under 35 U.S.C. 154(b) by 217 days.

(21) Appl. No.: 11/685,898

(22) Filed: Mar. 14, 2007

(65) Prior Publication Data

US 2008/0223619 A1 Sep. 18, 2008

(51) Int. Cl.
*E21B 10/28* (2006.01)

(52) U.S. Cl. ..... 175/331; 175/385; 175/374; 175/425

(58) Field of Classification Search ..... 175/331, 175/385, 374, 425
See application file for complete search history.

(56) References Cited

U.S. PATENT DOCUMENTS

| | | | | |
|---|---|---|---|---|
| 3,628,616 | A | 12/1971 | Neilson | |
| 4,591,008 | A | 5/1986 | Oliver | |
| 5,074,367 | A | 12/1991 | Estes | |
| 5,289,889 | A | 3/1994 | Gearhart et al. | |
| 5,415,243 | A | 5/1995 | Lyon et al. | |
| 5,492,186 | A * | 2/1996 | Overstreet et al. | 175/374 |
| 5,494,123 | A | 2/1996 | Nguyen | |
| 6,772,849 | B2 * | 8/2004 | Oldham et al. | 175/433 |
| 2006/0021800 | A1 | 2/2006 | Beuershausen et al. | |

FOREIGN PATENT DOCUMENTS

| | | | |
|---|---|---|---|
| GB | 2326894 | A | 1/1999 |
| WO | 2006099629 | A1 | 9/2006 |

* cited by examiner

*Primary Examiner*—David J Bagnell
*Assistant Examiner*—Brad Harcourt
(74) *Attorney, Agent, or Firm*—Bracewell & Giuliani LLP

(57) ABSTRACT

Strategically placed hardfacing material near the shank end of a drill bit above the transition edges provides additional protection for compensator areas and the upper leg surfaces of drill bits during updrilling and/or backreaming operations. The strategically located hardfacing is typically passive in the normal drill mode, but active in the updrill drilling mode and/or back reaming. Alternative designs including other strategic material placement, the formation of hardfacing materials in tooth/wear design shapes, bimetallic gage, graded composite hardfacing materials, recesses or cavities at edges of the outer diameter, and various methods of applying the material also may be employed.

40 Claims, 11 Drawing Sheets

SYSTEM, METHOD, AND APPARATUS FOR PASSIVE AND ACTIVE UPDRILL FEATURES ON ROLLER CONE DRILL BITS

BACKGROUND OF THE INVENTION

1. Technical Field

The present invention relates in general to drill bits and, in particular, to an improved system, method, and apparatus for passive and active updrill protective and cutting features for oil field tools such as roller cone drill bits.

2. Description of the Related Art

When drilling in formation with unconsolidated, highly abrasive sand formations, the legs of drill bits are subjected to the abrasive cuttings being drilled, the high sand content in the mud, and the sand particles along the borehole wall. Improvements in the shirttail and motor hardfacing and/or a combination of compacts have helped to limit the accelerated wear from occurring to the outer diameter of the legs in the normal (i.e., downward) drilling mode. However, a need exists to help protect the upper leg surfaces above the transition edge (such as compensator areas) from excessive wear, especially when back reaming is performed.

SUMMARY OF THE INVENTION

Embodiments of a system, method, and apparatus for providing additional protective and cutting features for oil field tools are disclosed. The invention is well suited for use on the upper leg surfaces of roller cone drill bits above the transition edge of the head outer diameter during up drilling. These objectives are accomplished by strategically placing a volume of metallurgically bonded hardfacing material near the shank end of the drill bit, such as between the leading transition edge and trailing transition edge.

The strategically located hardfacing is typically passive in the normal drill mode, but active in the updrill drilling mode and/or during back reaming. Alternative designs include other strategic material placement, the formation of hardfacing materials in tooth/wear design shapes, bimetallic gage, graded composite hardfacing materials, inverted radius at edges of the outer diameter, and various methods of applying the material also may be employed.

The hardfacing comprises a thickness of at about 0.25 inches or more, which is more than twice as thick as conventional hardfacing (i.e., typically on the order of 0.120 inches or less). This substantial increase in hardfacing thickness is made possible by the locations of the installation, which also facilitate enhanced geometric features (e.g., teeth shapes, etc.). The method of the invention may comprise removing material from the oil field tool above the transition edge edges, backfilling with hardfacing to those edges, optionally adding additional hardfacing above the original surface of the tool, and machining or shaping the hardfacing into various geometric designs. The hardfacing material itself may comprise iron or nickel-based materials. Examples include a matrix of Ni—Cr—B—Si with spherical cast WC. Processes for application of the hardfacing to oil field tools include those known to one skilled in the art, including oxy-acetylene, MIG, TIG, SMA, SCA, etc.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
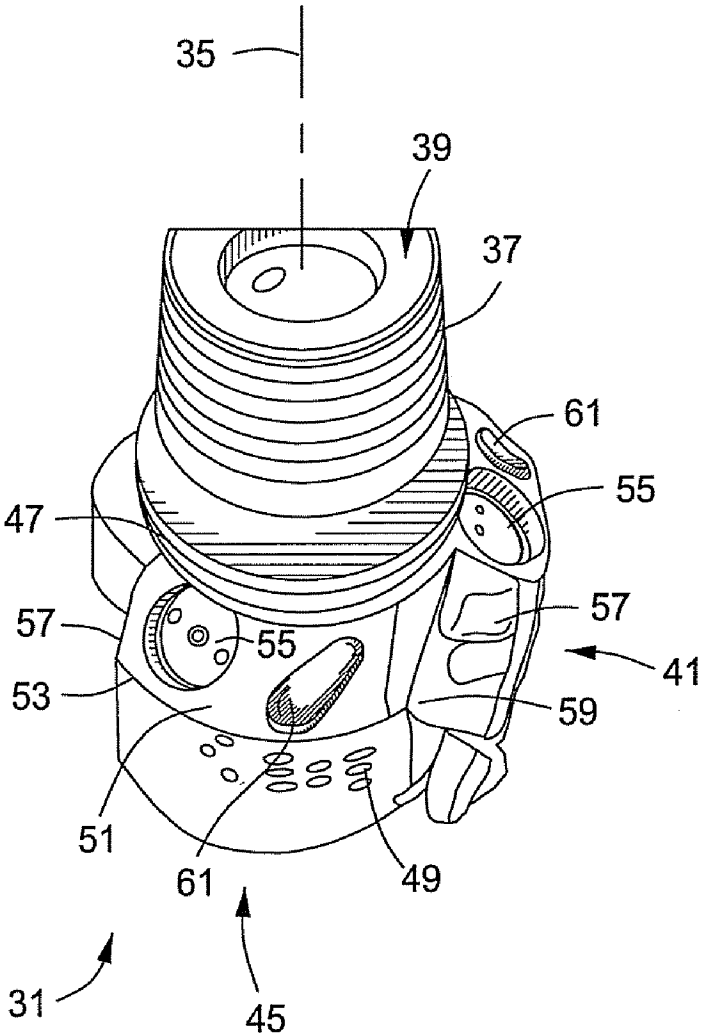
FIG. 1 is a side isometric view of one embodiment of a drill bit constructed in accordance with the present invention.
Figure 2:
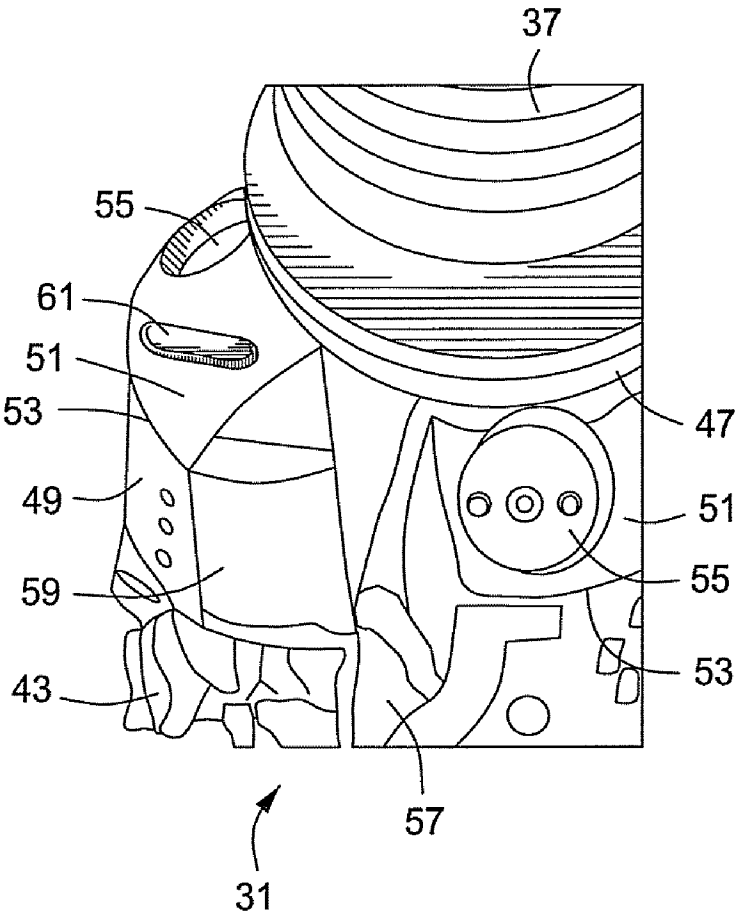
FIG. 2 is an enlarged, rotated isometric view of a portion of the drill bit of FIG. 1 and is constructed in accordance with the present invention.

Referring now to FIGS. 1 and 2, a drill bit 31 comprises a bit body having an axis 35, a shank 37 that defines a proximal end 39, and at least one leg 41 (e.g., three shown), each with a roller cone 43 located opposite the shank 37 that define a distal end 45. A thread shoulder or transition edge 47 is located between the shank 37 and the legs 41. A head outer diameter (OD) 49 defines the outer diameter of the drill bit 31 with respect to the axis 35. The head OD 49 may be equipped with or without extensions known as a boss pad.

One or more top transition surfaces 51 are located between the head OD 49 and the thread shoulder 47. Transition edges 53 are defined between the head OD 49 and the top transition surfaces 51. Compensator caps 55 are located in at least some of the top transition surfaces 51. One or more leading edge transition surfaces 57 are located on one side of respective ones of the head OD 49 and top transition surfaces 51, and one or more trailing edge transition surfaces 59 are located opposite the leading edge transition surfaces 57 on another side of said respective ones of the head OD 49 and top transition surfaces 51.

The drill bit 31 has a conventional down drilling mode wherein portions of the bit body that are distal to (i.e., below, in vertical drilling) the transition edge 53 are defined as "active" and directly encounter and cut formation during down drilling. The drill bit 31 also has an up drilling mode wherein portions of the bit body that are proximal to (i.e., above) the transition edge 53 and radially inboard of the head OD 49 are defined as "passive" (i.e., does not intentionally cut formation) during down drilling, but which are active during up drilling or back reaming. Accordingly, the portions that are active during down drilling typically become passive during up drilling.

The drill bit 31 also has metallurgically bonded hardfacing material 61 that is strategically located on the passive portions of the bit body. Unlike prior art designs, the hardfacing 61 has a thickness of about 0.25 inches or more. In another embodiment, a thickness of 0.050 inches or more may be used. Hardfacing 61 is for cutting formation and providing wear protection for the bit body during up drilling or back reaming. Accordingly, the hardfacing 61 is located axially above the transition edges 53, and radially inward of the maximum outer diameter of the drill (e.g., at head OD 49). As illustrated in FIGS. 1 and 2, the hardfacing 61 may be located on passive portions of the bit body, such as the top transition surfaces 51. In that embodiment, the hardfacing 61 extends diagonally across the top transition surfaces 51. Drill bit 31 also may comprise conventional hardfacing on portions that are active during down drilling.

As shown in the embodiments of FIGS. 3-6, the hardfacing 71 may be segmented in multiple portions and multiple locations, as well as comprise a plurality of thicknesses in the multiple portions and locations. For example, hardfacing 71 may cover substantially all of the top transition surfaces 51. In addition, the hardfacing 71 may comprise a greater thickness at portions 73 adjacent the compensator caps 55, and a lesser thickness at portions 75 away from the compensator caps 55. Hardfacing 71 also may comprise various geometric shapes, such as the tooth-like features 80 shown in FIG. 6.

Figure 4:
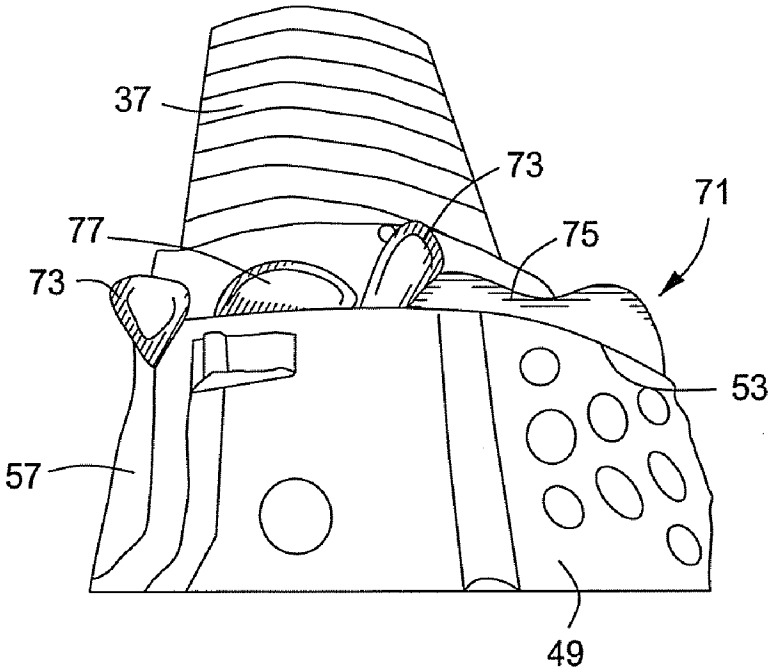
FIG. 4 is a lower isometric view of the drill bit of FIG. 3 and is constructed in accordance with the present invention.
Figure 3:
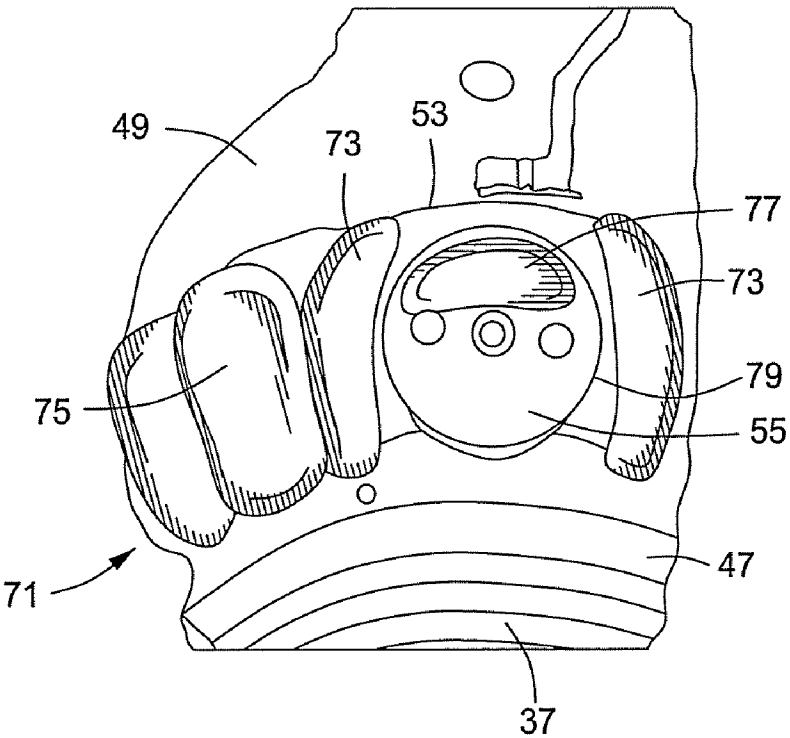
FIG. 3 is a top isometric view of a second embodiment of a drill bit constructed in accordance with the present invention.
Figure 5:
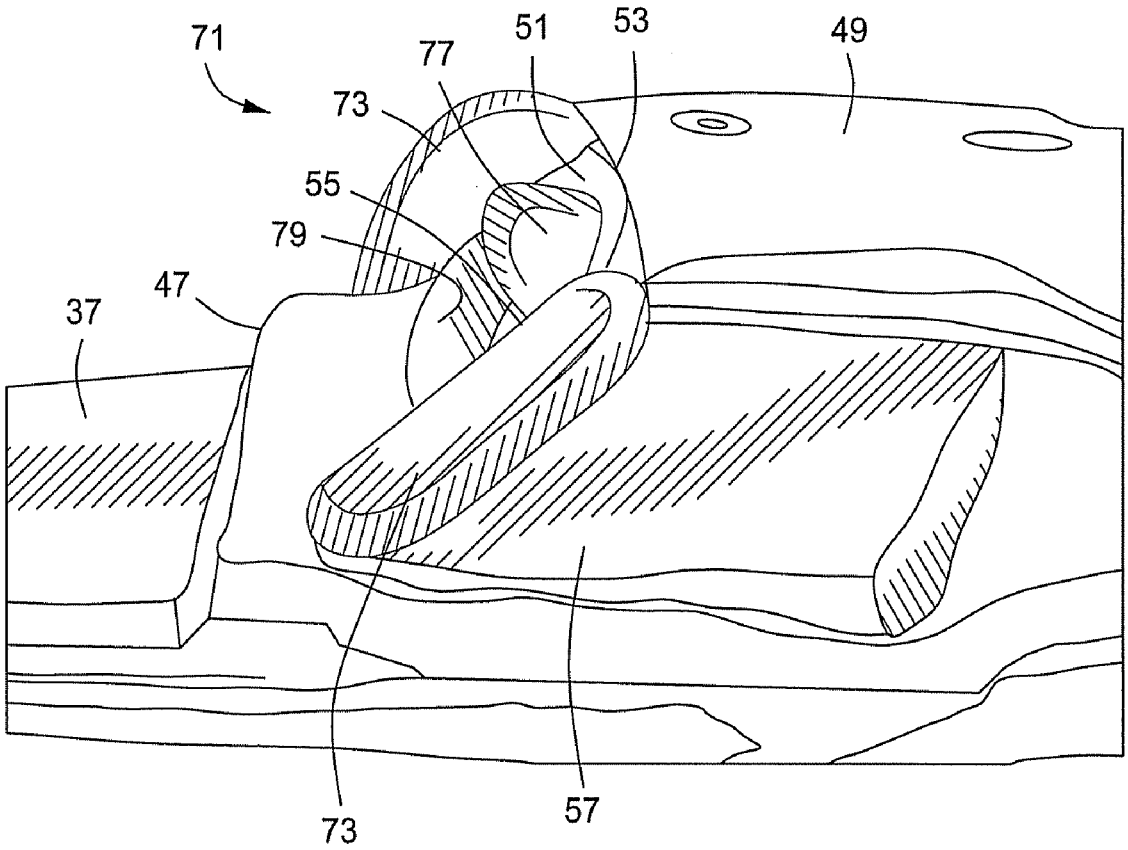
FIG. 5 is a side isometric view of the drill bit of FIG. 3 and is constructed in accordance with the present invention.
Figure 6:
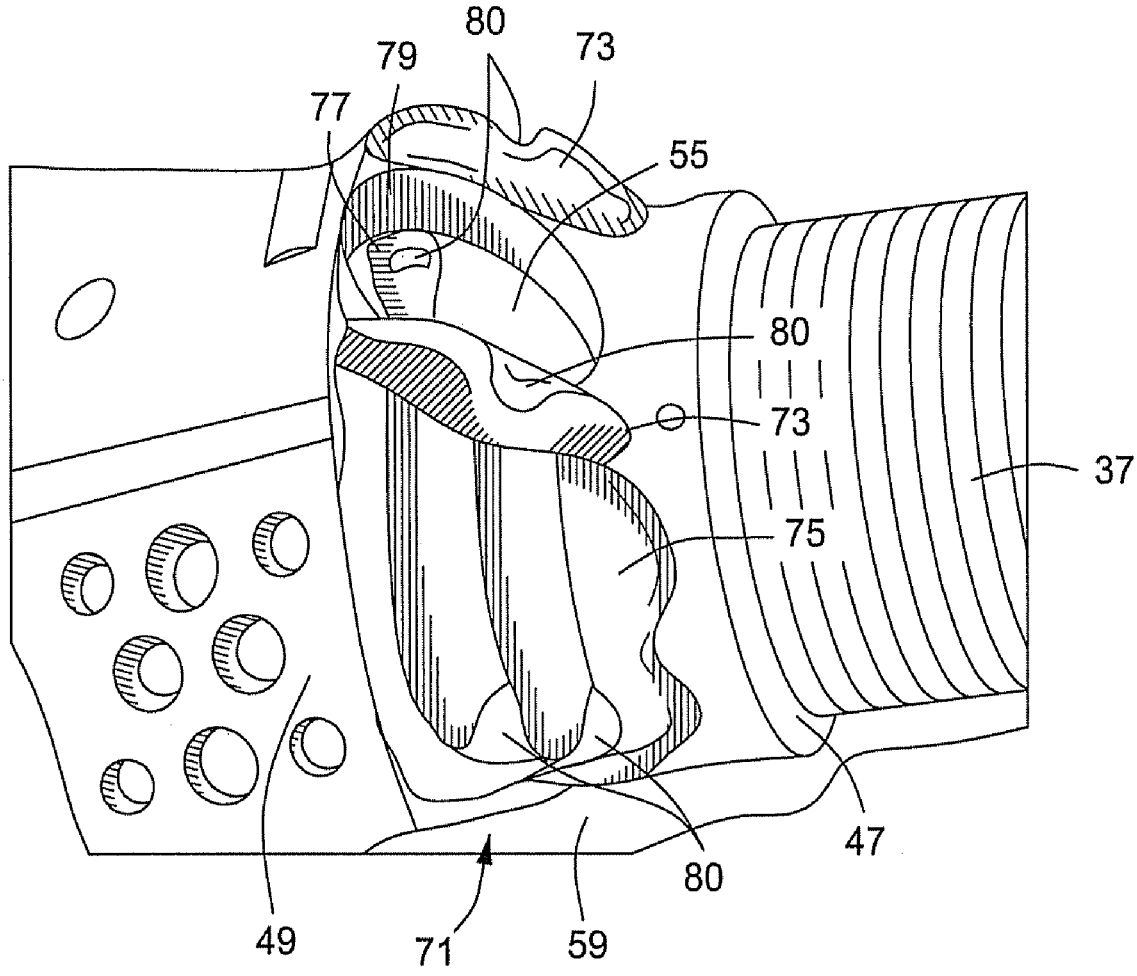
FIG. 6 is a side isometric view of a third embodiment of a drill bit constructed in accordance with the present invention.
Figure 17:
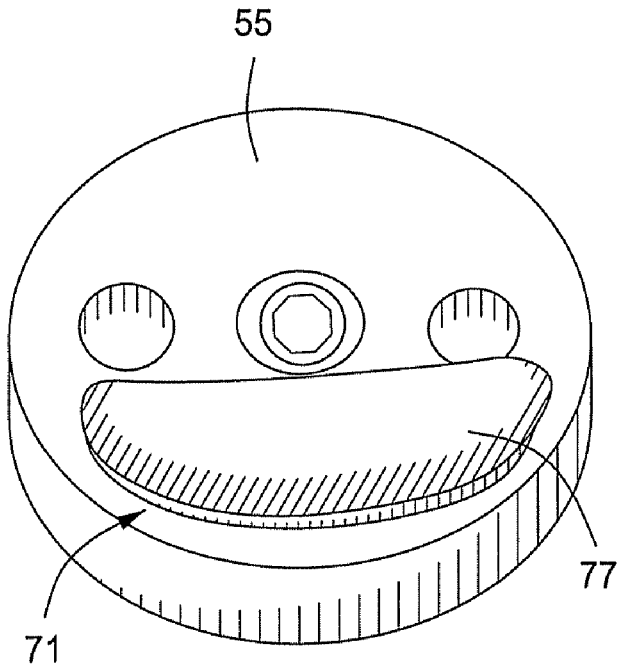
FIG. 17 is a top isometric view of an embodiment of a compensator cap for any of the foregoing drill bits and is constructed in accordance with the present invention.
Figure 18:
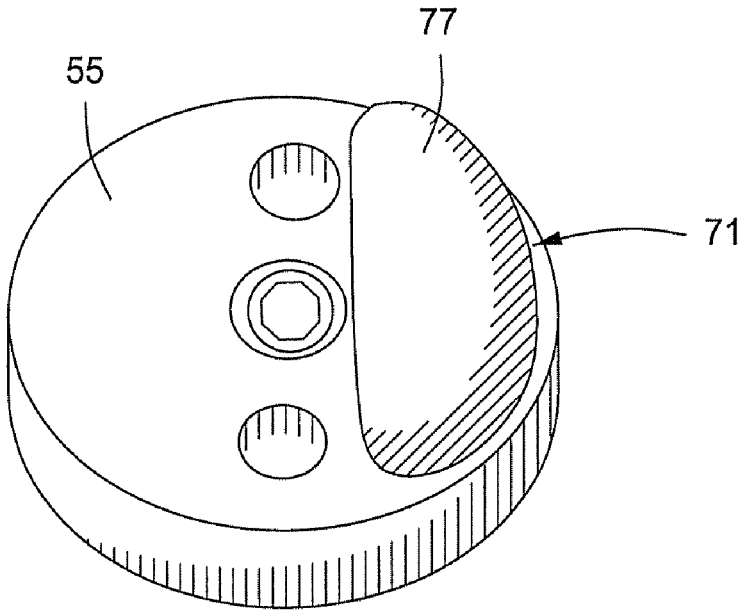
FIG. 18 is a side isometric view of another embodiment of a compensator cap for any of the foregoing drill bits and is constructed in accordance with the present invention.

In addition, a portion 77 of the hardfacing 71 also may be located on the compensator caps 55 (see, also, FIGS. 17 and 18). In some embodiments, the compensator caps 55 are located in apertures 79 that are recessed from the top transition surfaces 51, and the hardfacing 77 protrudes from the compensator caps 55 beyond the top transition surfaces 51 as best shown in FIGS. 4 and 5. The hardfacing 71 also may extend from the transition edges 53 to the thread shoulder 47. FIGS. 4 and 5 also illustrate that the hardfacing 71 may protrude from interfaces between the top transition surfaces 51 and respective ones of the leading edge transition surfaces 57, and from interfaces between the top transition surfaces 51 and respective ones of the trailing edge transition surfaces 59.

Figure 8:
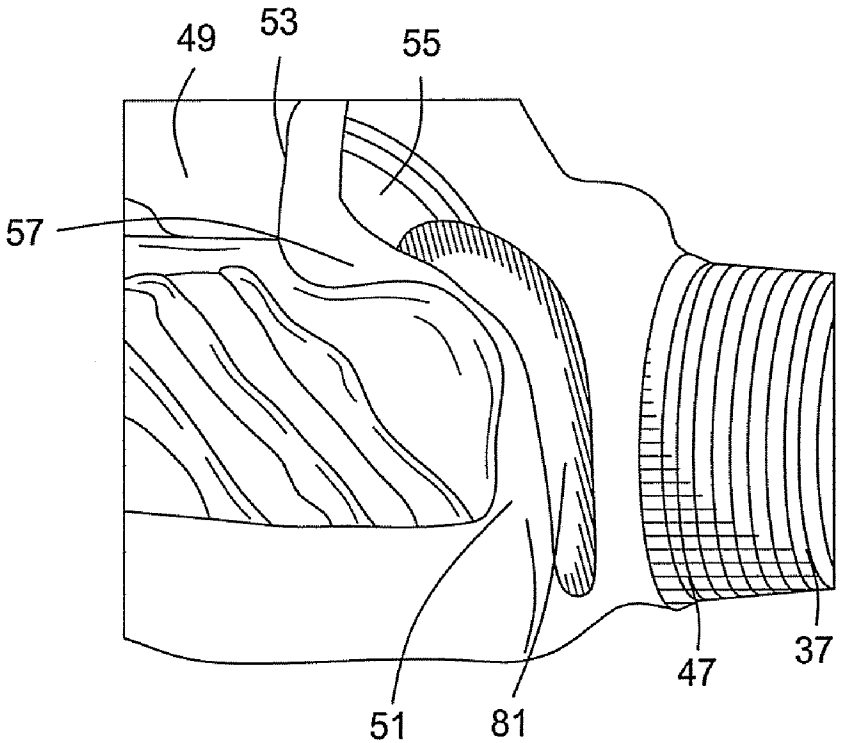
FIG. 8 is a side isometric view of the drill bit of FIG. 7 and is constructed in accordance with the present invention.
Figure 7:
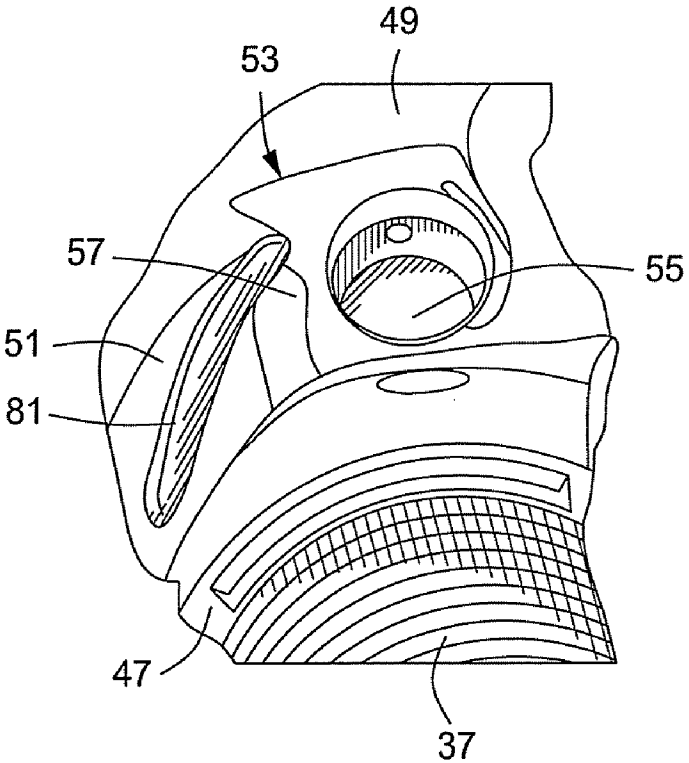
FIG. 7 is a top isometric view of a fourth embodiment of a drill bit constructed in accordance with the present invention.
Figure 10:
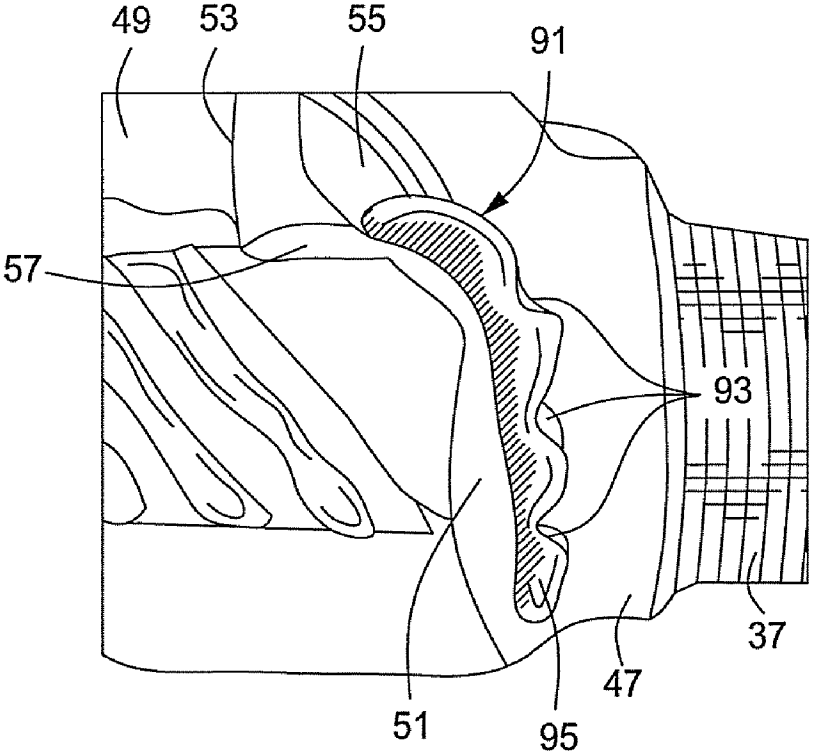
FIG. 10 is a side isometric view of the drill bit of FIG. 9 and is constructed in accordance with the present invention.
Figure 9:
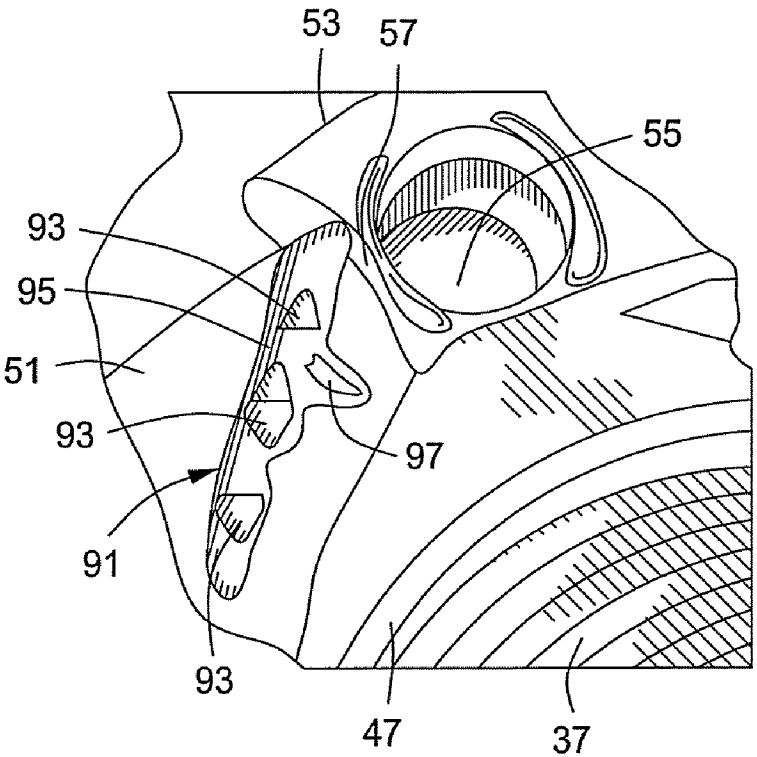
FIG. 9 is a top isometric view of a fifth embodiment of a drill bit constructed in accordance with the present invention.

In the embodiment of FIGS. 7 and 8, the hardfacing 81 extends contiguously from the top transition surfaces 51 to respective ones of the leading edge transition surfaces 57. In FIGS. 9 and 10, the hardfacing 91 is configured with teeth 93, a diagonal portion 95 of the hardfacing 91 extends across both the top transition surfaces 51 and the leading edge transition surfaces 57, and a lateral portion 97 of the hardfacing 91 protrudes orthogonally from the diagonal portion 95 toward the thread shoulder 47 on the top transition surfaces 51.

Figure 12:
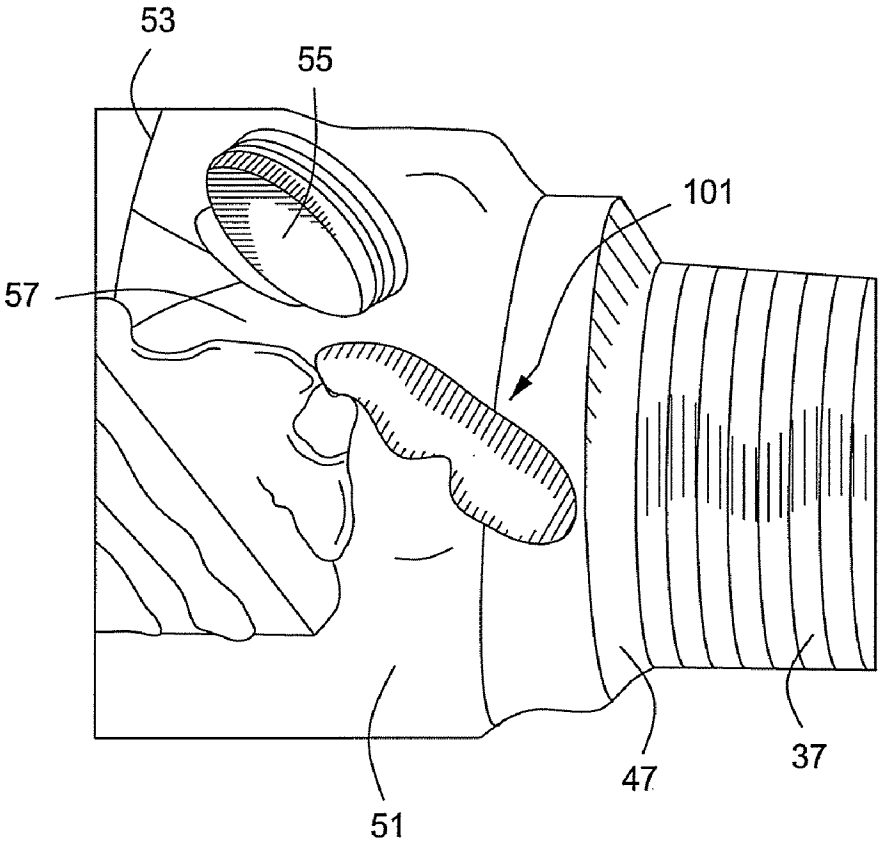
FIG. 12 is a side isometric view of the drill bit of FIG. 11 and is constructed in accordance with the present invention.
Figure 11:
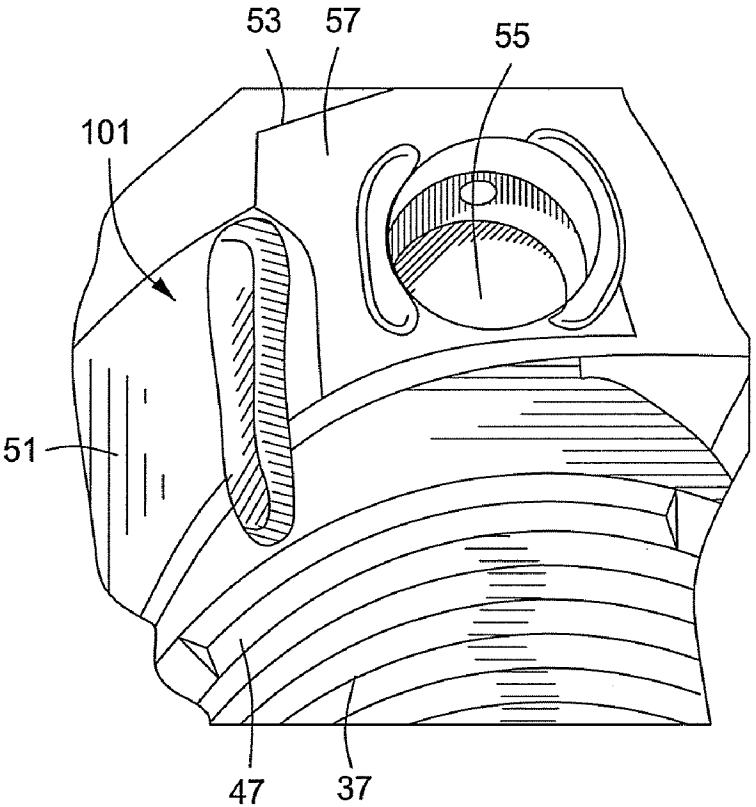
FIG. 11 is a top isometric view of a sixth embodiment of a drill bit constructed in accordance with the present invention.
Figure 14:
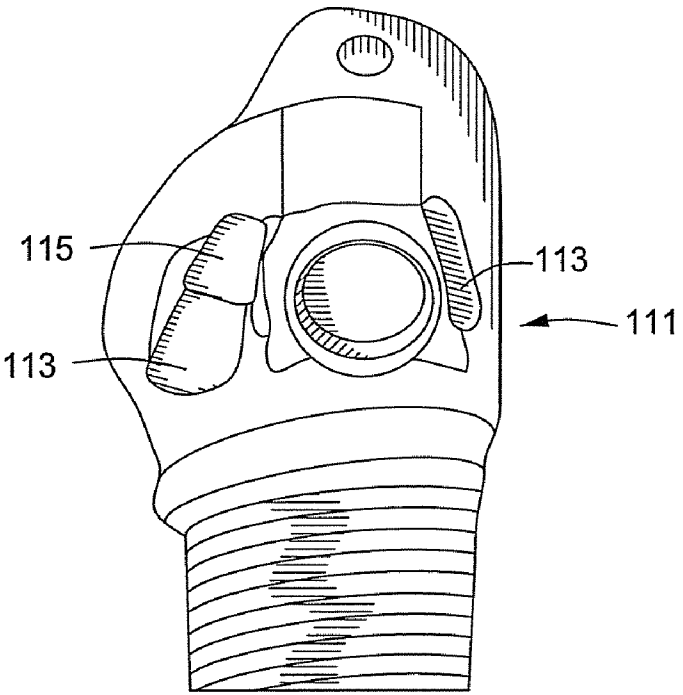
FIG. 14 is a top isometric view of the drill bit of FIG. 13 and is constructed in accordance with the present invention.
Figure 13:
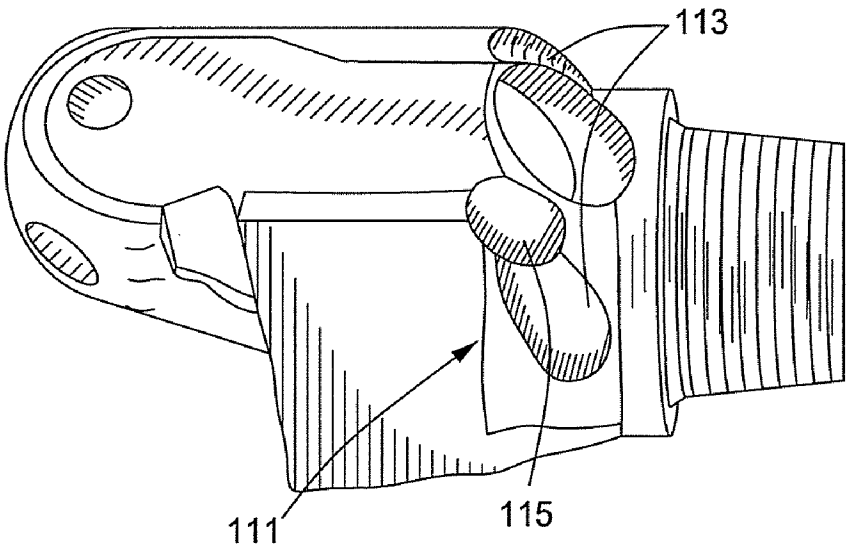
FIG. 13 is a side isometric view of a seventh embodiment of a drill bit constructed in accordance with the present invention.
Figure 16:
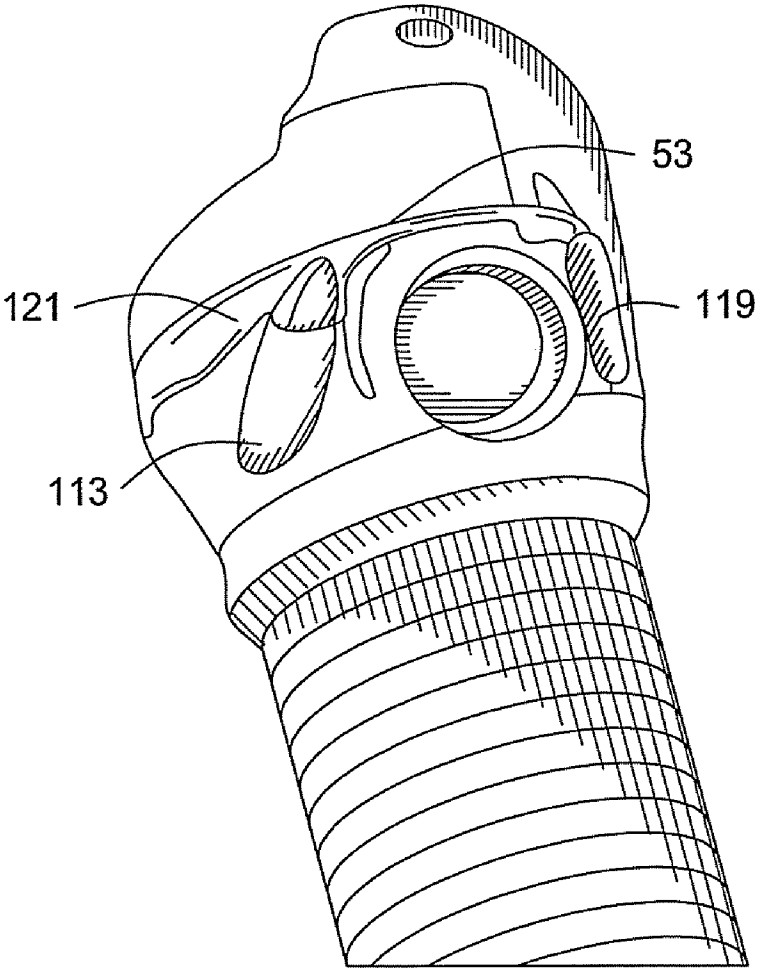
FIG. 16 is a top isometric view of a ninth embodiment of a drill bit constructed in accordance with the present invention.
Figure 15:
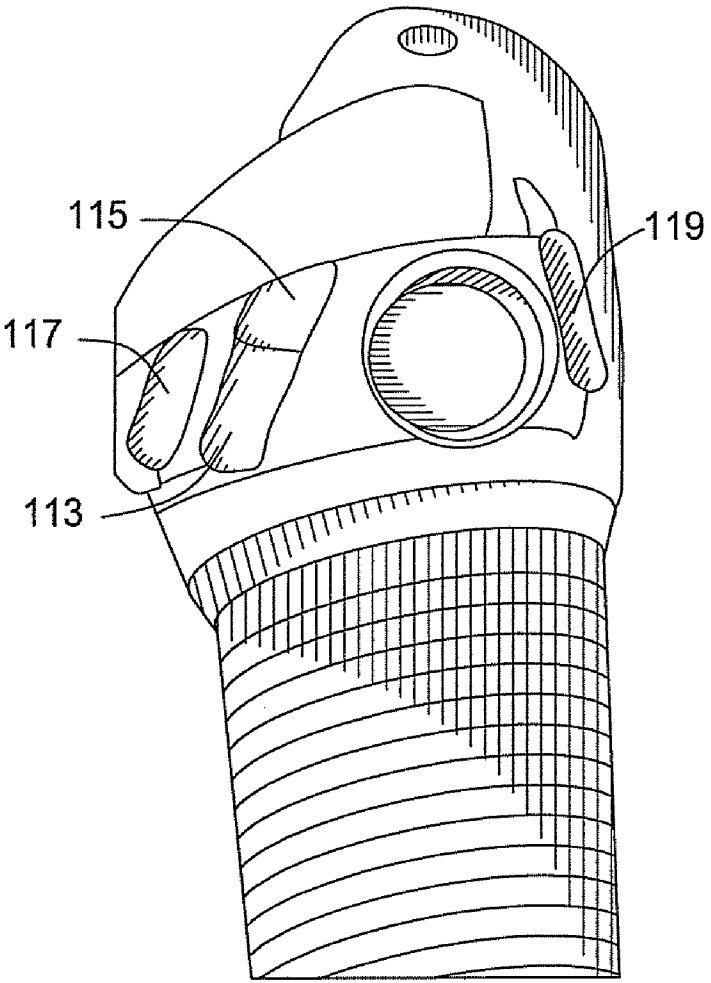
FIG. 15 is a top isometric view of an eighth embodiment of a drill bit constructed in accordance with the present invention.

As shown in FIGS. 11 and 12, hardfacing 101 may extend radially from the thread shoulder 47, across the top transition surfaces 51, to the interface with the leading edge transition surfaces 57. FIGS. 13 and 14 illustrate one embodiment of hardfacing 111 comprising both welded elements 113 and bimetallic elements 115. In FIG. 15, an embodiment having multiple, separate hardfacing segments, some of which are entirely bimetallic 117, some entirely welded 119, and some with combinations of materials 113, 115 are shown. In FIG. 16, hardfacing 121 spans substantially entire lengths of the transition edges 53.

Still other alternative designs for the hardfacing include further strategic material placement, the formation of hardfacing materials in tooth/wear design shapes, bimetallic gage, graded composite hardfacing materials, recesses or cavities at edges of the outer diameter, and various methods of applying the material also may be employed. Moreover, material may be removed from the passive portions of the bit body to form cavities. The cavities are then backfilled with hardfacing and comprise additional hardfacing extending out of the cavities above an original surface of the bit body.

The hardfacing material itself may comprise iron or nickel-based materials. Examples include a matrix of Ni—Cr—B—Si with spherical cast WC pellets, and/or spherical sintered WC pellets. Another example may include an iron matrix, again with spherical WC pellets, spherical cast WC pellets, crushed sintered WC, and/or crushed cast WC granules or any combination thereof. Processes for application of the hardfacing to oil field tools include those known to one skilled in the art, including oxy-acetylene, MIG, TIG, SMA, SCA, etc.

Figure 19:
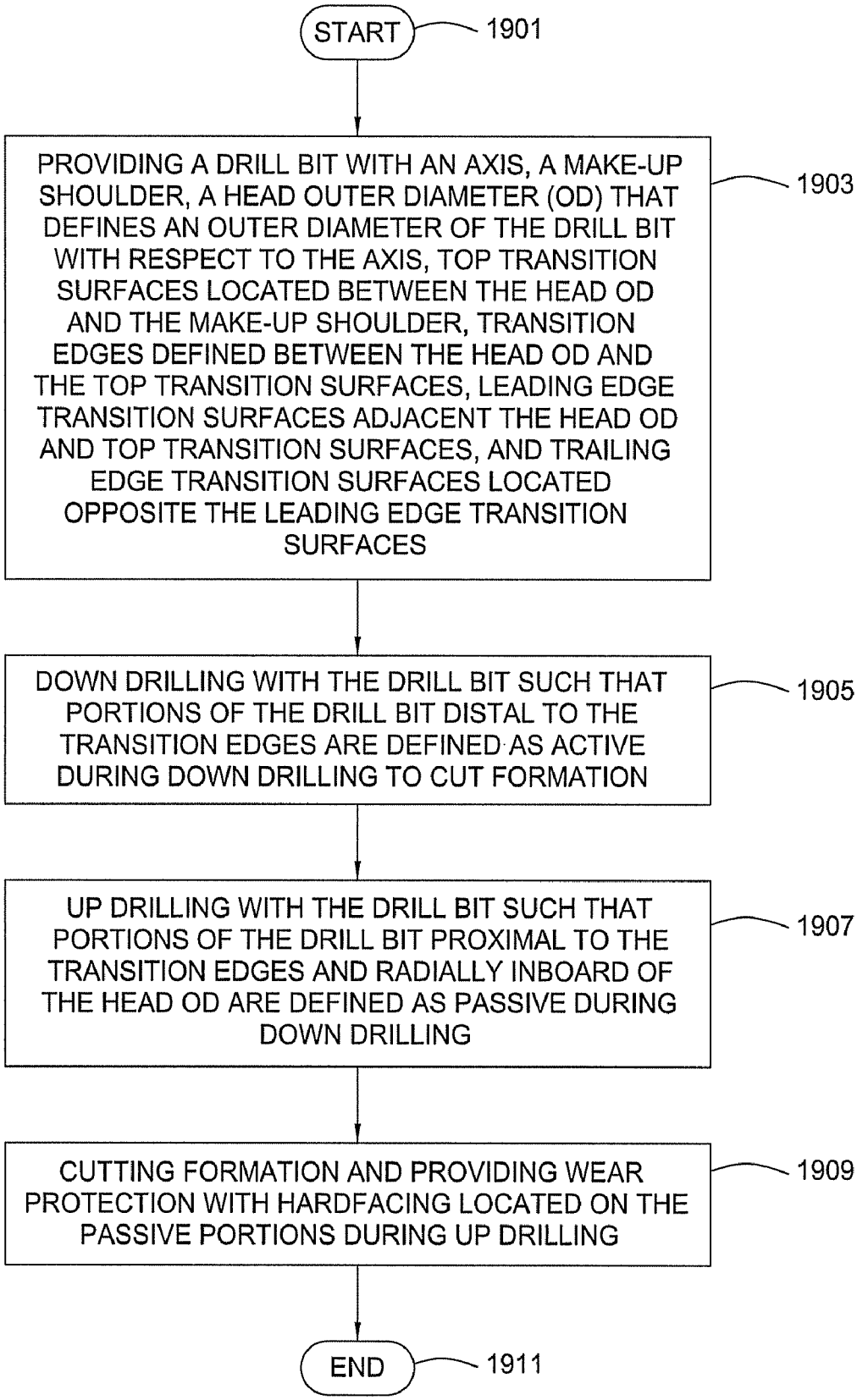
FIG. 19 is a high level flow diagram of one embodiment of method in accordance with the present invention.

Referring now to FIG. 19, one embodiment of a method of configuring a drill bit is illustrated. The method begins as indicated at step 1901 and comprises providing a drill bit with an axis, a make-up shoulder, a head outer diameter (OD) that defines an outer diameter of the drill bit with respect to the axis, top transition surfaces located between the head OD and the make-up shoulder, transition edges defined between the head OD and the top transition surfaces, leading edge transition surfaces adjacent the head OD and top transition surfaces, and trailing edge transition surfaces located opposite the leading edge transition surfaces (step 1903); down drilling with the drill bit such that portions of the drill bit distal to the transition edges are defined as active during down drilling to cut formation (step 1905); up drilling with the drill bit such that portions of the drill bit proximal to the transition edges and radially inboard of the head OD are defined as passive during down drilling (step 1907); cutting formation and providing wear protection with hardfacing located on the passive portions during up drilling (step 1909); before ending as indicated at step 1911. Other embodiments of the method may comprise steps that incorporate the various elements and limitations described herein.

While the invention has been shown or described in only some of its forms, it should be apparent to those skilled in the art that it is not so limited, but is susceptible to various changes without departing from the scope of the invention.

What is claimed is:

1. A system for both down drilling and up drilling with a drill bit, comprising:

a bit body having an axis, a shank that defines an upper end;

at least one bit leg with a roller cone located opposite the shank that define a lower end;

a make-up shoulder between the shank and the leg;

the bit leg defining an outer diameter of the drill bit with respect to the axis;

a top transition surfaces located above the bit leg;

a transition edges defined between the bit leg and the top transition surface;

a compensator cap located in an aperture in the top transition surfaces;

a leading edge transition surfaces and a trailing edge transition surface located on opposite sides of the top transition surface in a circumferential direction; and compensator area hardfacing on the top transition surface on leading and trailing sides of the aperture for the compensator cap, for cutting formation and providing wear protection for the bit body during up drilling or back reaming.

2. A system according to claim 1, wherein the compensator area hardfacing comprises a bead of hardfacing on the leading side and a bead of hardfacing on the trailing side of the aperture for the compensator cap, the beads of hardfacing curving partially around the aperture.

3. A system according to claim 2, wherein the beads of compensator hardfacing are generally concentric with a center of the apertures for the compensator caps and have ends that join transition edge hard facing along the transition edge.

4. A system according to claim 1, further comprising diagonal hardfacing that extends diagonally across the top transition surfaces.

5. A system according to claim 1, further comprising top transition hardfacing on the top transition surface that joins the compensator area hard facing to cover substantially all of the top transition surface.

6. A system according to claim 1, further comprising compensator cap hard facing located on the compensator cap.

7. A system according to claim 6, wherein the compensator cap hardfacing protrudes from the compensator caps beyond the top transition surfaces.

8. A system according to claim 1, further comprising top transition hardfacing that is segmented in multiple locations and spaced from the compensator area hardfacing.

9. A system according to claim 1, wherein the compensator area hardfacing substantially extends from the transition edges to the make-up shoulder.

10. A system according to claim 1, further comprising leading edge hardfacing on the leading edge transition surface and on the trailing edge transition surfaces.

11. A system according to claim 1, further comprising top transition hardfacing on the top transition surface that has a lesser thickness than the compensator area hardfacing.

12. A system according to claim 11, wherein at least one portion of the compensator area hardfacing has a recess to define a configuration resembling earth boring hit teeth.

13. A system according to claim 1, further comprising top transition hardfacing that extends from the make-up shoulder, across the top transition surfaces, to the leading edge transition surfaces.

14. A system according to claim 1, further comprising transition edge hardfacing that spans substantially entire lengths of the transition edges.

15. A system according to claim 1, wherein the compensator area hardfacing has a thickness of about 0.25 inches or more.

16. A system according to claim 1, wherein the compensator area hardfacing comprises welded elements and bimetallic elements.

17. A roller cone drill bit, comprising:

a bit body having an axis;

a shank that defines a proximal end;

bit legs with roller cones located opposite the shank that define a distal end;

a make-up shoulder between the shank and each of the legs;

the bit legs defining an outer diameter of the drill bit with respect to the axis;

top transition surfaces located above each of the bit legs and facing upward and outward relative to the axis of the bit body;

transition edges defined between the bit legs and the top transition surfaces;

compensator caps located in apertures in the top transition surfaces;

a leading edge transition surface and a trailing edge transition surface located on opposite sides of each of the top transition surfaces in a circumferential direction; and compensator area hardfacing beads located on the top transition surfaces of the passive portions on the leading and trailing sides of each of the compensator caps for cutting formation and providing wear protection for the bit body during up drilling or back reaming, each of the compensator area hardfacing beads curving generally concentrically relative to a center of the aperture for the compensator cap.

18. A roller cone drill bit according to claim 17, further comprising diagonal hardfacing beads extending diagonally across the top transition surfaces.

19. A roller cone drill bit according to claim 17, further comprising top transition hardfacing that joins the compensator area hardfacing beads to cover substantially all of the top transition surfaces.

20. A roller cone drill bit according to claim 19, wherein the compensator area hardfacing beads have a greater thickness than the top transition hardfacing.

21. A roller cone drill bit according to claim 17, wherein the compensator caps are recessed in the apertures from the top transition surfaces, and the bit further comprises compensator cap hardfacing on the compensator caps that protrudes from the compensator caps beyond the top transition surfaces.

22. A roller cone drill bit according to claim 17, further comprising top transition hardfacing that is segmented in multiple locations on each of the top transition surfaces.

23. A roller cone drill bit according to claim 17, wherein the compensator area hardfacing beads have ends that join transition edge hardfacing along the transition edges.

24. A roller cone drill bit according to claim 17, further comprising interface hardfacing on the leading edge transition surfaces and on the trailing edge transition surfaces.

25. A roller cone drill bit according to claim 17, further comprising top transition hardfacing on the top transition surface that has recesses to define a configuration resembling earth boring bit teeth.

26. A roller cone drill bit according to claim 17, further comprising top transition hardfacing that extends across the top transition surfaces to the leading edge transition surfaces.

27. A roller cone drill bit according to claim 17, further comprising transition edge hardfacing that spans substantially entire lengths of the transition edges.

28. A roller cone drill bit according to claim 17, wherein the compensator area hardfacing beads comprise welded elements and bi-metallic elements.

29. A method of configuring a drill bit, comprising:

(a) providing a drill bit with an axis, a make-up shoulder, bit legs that define an outer diameter of the drill bit with respect to the axis, top transition surfaces located above the bit legs and facing upward and outward relative to the axis, compensator caps recessed in apertures in the top transition surfaces, transition edges defined between the bit legs and the top transition surfaces, leading edge transition surfaces and trailing edge transition surfaces located on opposite sides of each of the top transition surfaces in a circumferential direction;

(b) applying compensator area hardfacing on the top transition surface on leading and trailing sides of each of the apertures containing the compensator caps;

(c) down drilling with the drill bit such that portions of the drill bit below the transition edges are defined as active during down drilling to cut formation;

(d) up drilling with the drill bit such that portions of the drill bit above the transition edges and radially inboard of the bit leg are defined as passive during down drilling; and (e) cutting formation and providing wear protection with the compensator area hardfacing during up drilling.

30. A method according to claim 29, wherein step (b) further comprises applying top transition hardfacing on the top transition surfaces adjacent the compensator area hardfacing.

31. A method according to claim 30, wherein step (b) further comprises applying top transition hardfacing diagonally across the top transition surfaces.

32. A method according to claim 30, wherein step (b) further comprises covering substantially all of the top transition surfaces with top transition hardfacing, which joins the compensator area hard facing.

33. A method according to claim 32, wherein the compensator area hardfacing has a greater thickness than the top transition hardfacing.

34. A method according to claim 33, wherein step (b) further comprises applying compensator cap hardfacing on the compensator caps such that the compensator cap hardfacing protrudes beyond the top transition surfaces.

35. A method according to claim 29, wherein step (b) further comprises applying transition edge hardfacing to the transition edges and joining the transition edge hardfacing with the compensator area hardfacing.

36. A method according to claim 29, wherein step (b) comprises applying curved beads of the compensator area hardfacing at least partially around each of the apertures, the curved beads being generally concentric with a center of each of the apertures.

37. A method according to claim 29, wherein step (b) further comprises applying interface hardfacing on each of the leading edge transition surfaces and on each the trailing edge transition surfaces.

38. A method according to claim 29, wherein step (b) further comprises configuring the compensator area hardfacing to resemble teeth of an earth boring bit.

39. A method according to claim 29, wherein step (b) further comprises applying top transition hardfacing from the make-up shoulder across each of the top transition surfaces to the leading edge transition surfaces.

40. A method according to claim 29, wherein step (b) further comprises applying transition edge hardfacing across substantially entire lengths of the transition edges.

* * * * *

UNITED STATES PATENT AND TRADEMARK OFFICE

CERTIFICATE OF CORRECTION

PATENT NO. : 7,677,338 B2
APPLICATION NO. : 11/685898
DATED : March 16, 2010
INVENTOR(S) : James L. Overstreet et al.

It is certified that error appears in the above-identified patent and that said Letters Patent is hereby corrected as shown below:

Column 1, line 48, delete "at" before "about"
Column 1, line 55, delete "edge" after "transition"

Signed and Sealed this

Twenty-second Day of June, 2010

David J. Kappos

David J. Kappos
*Director of the United States Patent and Trademark Office*